US006196277B1

(12) United States Patent
Till et al.

(10) Patent No.: US 6,196,277 B1
(45) Date of Patent: Mar. 6, 2001

(54) METHOD AND DEVICE FOR FILLING BARRELS

(75) Inventors: Volker Till, Hofheim; Hans-Jürgen Wall, Weissensberg, both of (DE)

(73) Assignee: Gea Till GmbH & Co., Kriftel (DE)

( * ) Notice: Subject to any disclaimer, the term of this patent is extended or adjusted under 35 U.S.C. 154(b) by 0 days.

(21) Appl. No.: 09/381,003

(22) PCT Filed: Apr. 8, 1998

(86) PCT No.: PCT/EP98/02058

§ 371 Date: Sep. 13, 1999

§ 102(e) Date: Sep. 13, 1999

(87) PCT Pub. No.: WO98/49089

PCT Pub. Date: Nov. 5, 1998

(30) Foreign Application Priority Data

Apr. 29, 1997 (DE) ..... 197 18 130
Sep. 18, 1997 (DE) ..... 197 41 254

(51) Int. Cl.[7] ..... B65B 1/04

(52) U.S. Cl. ..... 141/48; 141/9; 141/10; 141/63

(58) Field of Search ..... 141/39–50, 9, 141/100, 63, 64; 137/170.1, 170.2, 170.3

(56) References Cited

U.S. PATENT DOCUMENTS 3,802,471 * 4/1974 Wickenhauser ..... 141/39

* cited by examiner

*Primary Examiner*—Steven O. Douglas
(74) *Attorney, Agent, or Firm*—Alix, Yale & Ristas, LLP

(57) ABSTRACT

Disclosed is a method for filling barrels (4), specially kegs, with liquids, wherein at least one gas is dissolved. The barrel (4) is pre-stressed using a gas before the liquid is filled. Liquid is then fed into the barrel (4) by means of a filling valve (2) pertaining to a filling station (1) and connected to a feed line (3, 8). During filling, the pre-stress gas contained in the barrel (4) is evacuated. In order to guarantee economical and ecological product processing, the pre-stress gas in the barrel (4) is pre-stressed at only a partial pressure which corresponds approximately to the saturation pressure of the $CO_2$ or $N_2$ which is dissolved in the filled liquid. The flow rate speed is measured in the product feed line and is directly adjusted by adapting the volumetric flow rate of said product.

17 Claims, 4 Drawing Sheets

REGULATION OF THE DIFFERENCE IN PRESSURE

The flow velocity depends on:
the difference in pressure = product pressure - gas counter-pressure

REGULATION OF THE PRODUCT THROUGH-FLOW

The flow velocity depends on:
the flow cross section

Invention

METHOD AND DEVICE FOR FILLING BARRELS

CROSS REFERENCE TO RELATED APPLICATION

This is the U.S. national phase of International Application No. PCT/EP98/02058 filed Apr. 8, 1998.

BACKGROUND OF THE INVENTION

The invention concerns a method for filling barrels, especially kegs, with liquids, in which at least one gas is dissolved, whereby the barrel is pre-stressed with a pre-stress gas before being filled with liquid, after which liquid is fed to the barrel by means of a filling valve of a filling station, connected to a feed line, and the pre-stress gas contained in the barrel is removed during the filling process, as well as a device to carry out this method.

Carbon dioxide-containing beverages such as beer only keep their $CO_2$ in solution, if the partial pressure of the $CO_2$ gas above the liquid is at least as high as the saturation pressure in the liquid. If the gas pressure above the liquid is below the saturation pressure, the liquid loses $CO_2$; but if the gas pressure is substantially above this, there is a danger that additional $CO_2$ will go into solution. The uptake of gas will depend on the differential pressure between the saturation pressure in the liquid and the partial pressure above the liquid, the time available for the gas exchange, which is generally the same as the filling time of the barrel, and the size of the gas exchange area, i.e., the liquid surface. The danger of a gas uptake during the filling is significantly increased because of turbulence in the liquid occurring during the filling process. However, the gas exchange between liquid and the overlying gas atmosphere concerns not only the $CO_2$, but also other gases present in the gas atmosphere, especially oxygen, which is taken up by the liquid according to the same laws. Yet oxygen is a major factor of product quality in the case of liquids, which can be damaged by microorganisms or whose shelf life is endangered by oxidation of the liquid's components.

In order to get the product through a valve into the barrel, whether a bottle or a keg, a differential pressure between feed line and interior of the barrel is necessary. The magnitude of the differential pressure determines the inflow rate of the product. Usually, in order to avoid increases of surface due to turbulence, the product is filled with initially low speed, which is then slowly increased. For this, the barrel is pre-stressed with a gas pressure that is substantially higher than the saturation pressure of the gas dissolved in the liquid. The actual liquid being filled is also maintained at this pressure level by tanks or pumps and supplied to the filling machine. After the pre-stressing of the barrel to the pressure of the supplied liquid, a connection is established between barrel and product feed line. The filling of the barrel with product is made possible by controlled venting of the pre-stress gas present in the barrel In this process, the differential pressure which is built up determines the flow rate of the liquid. Moreover, it is known that the gas escape is throttled toward the end of the filling, which reduces the differential pressure between the interior of the barrel and the feed line. This has the effect of reducing the quantity of product filled per unit of time toward the end of the filling process, which enables a precise shutoff when reaching a set quantity. This known method is termed "back gas control". The advantage of this control method is that the gas pressure above the liquid is at all times above the saturation pressure of the product.

The pre-stress pressure to be established is found by trial and error. At the start of the filling, the product should lose $CO_2$ through turbulence, which results in local underpressures. This produces a desirable artificial foam on the liquid surface, whose bubbles contain only the released $CO_2$ and, thus, protect the product against contact with the oxygen-containing gas atmosphere above it. During the further filling, the turbulence vanishes and so do the local underpressures. During the remaining fill time, the product again takes up $CO_2$. Thus, the trick is to achieve an equilibrium between loss and further uptake of $CO_2$ as a function Of $CO_2$ content, temperature, barrel size, and estimated filling time.

Apart from the fact that the barrel has to be pre-stressed far above the saturation pressure in the case of back gas control and venting has to be conducted in a controlled manner in order to achieve a controlled filling rate, the reduction in the filling rate during the last filling segment is a problem. At constant inlet pressure of the liquid, the flow velocity can only be reduced if the differential pressure is decreased. For this, in the known techniques, the gas escape is throttled (or shut off, in extreme cases) and one waits until the increasing liquid level has achieved a raising of the counterpressure to the desired value by compressing the remaining gas volume present in the barrel. This period of time can be considerable, especially in the case of beer barrels. Thus, a 50-liter keg usually has an inlet cross section DN21, a maximum filling rate of 2.5 l/sec. and a differential pressure of 0.8 bar. If the keg is filled with 35 liters, then 15 liters of gas space must be compressed by 0.7 bar to reduce the rate. This requires $15 \times 0.7 = 10.5$ liters of liquid and (given the reducing rate of filling) around 8 seconds of filling time. Thus, a fast, accurate control is not possible, especially with possible fluctuation in feed pressures. Even more critical is the situation when not just one gas (for example, $CO_2$), but two gases (for example, $CO_2$ and $N_2$) are deliberately dissolved in the product. $N_2$ is added to beer nowadays for its foam stabilizing action. The best example of this is stout beer, whose creamy, long-lasting foam is produced by the dissolved $N_2$ released during tapping. But $N_2$ and $CO_2$ have completely different solubilities and saturation pressure curves. While $CO_2$ goes easily into solution and can only be brought out of solution with difficulty, it is extremely hard to place $N_2$ in solution at all, and very easy to take it out of solution with the smallest amount of turbulence. A balance between outgassing at the start of filling and recapture of lost gas during the filling is almost impossible to find in the case of 2-gas systems. The quality of the product being filled therefore fluctuates. One tries to compensate for this by maintaining the ratio of the gas atmosphere $CO_2$ to $N_2$ different than the proportion of the dissolved gases. But this compromise only holds for one temperature or one barrel size and only for one product feed pressure. Mastery of these many factors and their tolerances with a control technique is not possible.

Another drawback of back gas control is that the barrel needs to be pre-stressed far above the saturation pressure with gas, generally $CO_2$, in order to accomplish a pressure drop, which still lies above the saturation pressure of the gas even during maximum lowering of the interior pressure during the filling process. Since the gas is then vented into the atmosphere, this results in increased consumption of the greenhouse gas $CO_2$, in addition to energy consumption, Furthermore, the operating personnel are exposed to the high emission of $CO_2$.

A process of this type is known from GB-A-2,116,530 in which the kegs are filled by means of a connecting fitting that faces downward, whereby the liquid flows in through the carbon dioxide valve of the connecting fitting and the expelled gas is led off through the pressure release valves. Once the beer finally flows over the upper edge of the ascending tube, the barrel is completely full. In order to permit filling of the beer into kegs such that this is accompanied by low turbulence and low foaming and, in particular, a feature is provided that filling is carried out in 3 phases, whereby a first predetermined volume of liquid is measured out in an Initial stage and then this is introduced slowly into the keg and then a second predetermined volume of liquid is measured out in the subsequent rapid filling phase and this is introduced rapidly into the keg, and a third predetermined volume of liquid is measured out in the concluding phase of filling the vessel completely and this is then slowly introduced into the keg. The volumes of liquid, which are introduced into the keg on each occasion, are ascertained by means of an inductive gauge in the liquid line and are forwarded to an electronic evaluation and switching system, within which the measured voltage is digitized and forwarded to a gauge which Is calibrated in "liters" and which indicates the total volume of the keg. The volumes, which are desired for the individual filling phases, can be prescribed by a target value adjusting unit. In order to achieve the different filling volumes in the individual filling phases, an additional filling line is hooked up in the rapid filling phase. Thus the basis of the known process is the provision of two limiting values for the volume, which are capable of parameterization, whereby one can switch between a large and a small filling line on reaching these limiting values, The throughflow rate in the product supply line is not regulated.

Thus, the object of the Invention is to make smooth filling possible and to reduce the consumption of the pre-stressing gas.

In accordance with the invention, this object is solved, In essence, by the feature that the pre-stressing gas In the barrel is pre-stressed merely to a partial pressure which corresponds approximately to the saturation pressure of one of the gases which is dissolved in the liquid, which is being introduced, and that the flow-flow rate In the product supply line is measured and is regulated directly by altering the flow volume of the product.

In contrast to the prior art, the initially slow flowing in of the product and the increase in the flow velocity at the end of filling is no longer regulated indirectly by modulating the internal pressure of the keg but, rather, direct regulation of the flow volume of the product takes place.

An essential advantage of this new process resides in the feature that one can dispense completely with the previously necessary Installation of sensors for the product pressure since these pressures are no longer determinant for producing the flow velocity. As a result, the use of these highly precise and sensitive sensors and their technical-measurement calibration adjustment are no longer required.

A container, which is filled with a counter-pressure gas, is capable of reacting only very sluggishly to product fluctuations by increasing or decreasing the pressure of the relatively large volume of gas by blocking or opening the gas outlet. The change In pressure depends on the slowly rising level of product in the barrel. In the case of the present invention, on the other hand, the flow rate of the product into the keg can be kept stable at the desired predetermined value, despite changing product or countergas pressures due to change in the flow cross section.

The first cold product entering the hot keg causes residual quantities of atmospheric sterile steam in the barrel to suddenly condense. The pressure-modulating methods used thus far were not able to control this pressure collapse fast enough. The new method solves this task without difficulties and guarantees a controlled slow inflow of product, which is the prerequisite for a careful filling.

In a further modification of the invention, various filling curves can be entered into a data-processing unit to account for certain barrel sizes, types of fittings, different product temperatures and/or certain propellant gas ratios. These curves are produced by algorithms which are calculated or empirically obtained and which automatically correlate the appropriate flow velocities with the mentioned barrel components or product conditions. Thus, new product/barrel combinations can organize and process optimized self-learning fill profiles in this system. The filling curves are the setpoint values used to regulate the product volume flow.

In a preferred embodiment of this concept of the invention, the filling curves can be graphically modified and adjusted during production, e.g., with graphic interaction systems.

The gas inside the barrel can then be forced out by the incoming product through a simple overflow valve. The costly control apparatus formerly customary is no longer required for this. In the case of liquids containing several dissolved gases, the optimal gas composition can be established inside the barrel, since the same pressure prevails inside the barrel throughout the entire time of the filling process. In the conventional back gas control, the fluctuating pressures inside the barrel during the filling process resulted in different gas exchange behavior and, thus, an influencing of product quality during the various filling phases. This is completely eliminated by the invention.

According to a preferred modification of the invention, the pre-stress pressure inside the barrel is adjusted according to the saturation pressure after the filling. The basis for this concept of the invention is the fact that beer kegs are steamed for sterilization prior to filling and the cold product is poured into the still hot barrel. Fifty liters of beer with a temperature of around 3° C. are poured into an approximately 12 kg metal barrel with a temperature of 100° C. A mixing and equalization temperature is produced, which increases the temperature of the product in the barrel by around 4° C. relative to the feed temperature. This, of course, alters the saturation pressures of the dissolved gases, so that the value to be adjusted according to the invention must correspond to that of the product in the filled barrel. This issue never came up in the past, because the counter-pressure was always considerably above the saturation pressure.

A device to carry out the above-described method with a filling station, which supplies product liquid to be filled into the barrel across a feed line and from which pre-stress gas escaping from the barrel is taken away through a return gas line, has, according to the invention, a flow meter at the filling station to determine the flow-through velocity in the feed line of the filling station and a controllable diaphragm to adjust the product volume flow. In this way, the volume flow at each filling station can be individually adjusted as a function of the filling quantity or filling level, absolutely independent of the feed pressure of the product being filled and independent of the other filling stations, which might be present at the filling machine. In many cases, furthermore, there is a simplification of the customary pressure tanks upstream from the filling machines and their controls, since these likewise can be adjusted to the optimal gas mixture corresponding to the relations at saturation pressure, without influencing the product.

The product volume flow is regulated by a controller on the basis of the flow velocity determined by the flow meter as the actual value and a filling curve as the setpoint value, preferably adjusted to the barrel size, type of fitting, product temperature and/or proportions of propellant gas in the product and stored in a data-processing unit. According to the invention, the diaphragm cross section is continuously adjustable for this.

According to a preferred embodiment of the invention, an overflow valve is provided in the return gas line, through which the return gas is taken away. Further modifications, advantages, and application possibilities of the invention will follow from the description of an example of embodiment and the drawing below.

DETAILED DESCRIPTION OF THE PREFERRED EMBODIMENTS

Figure 1:
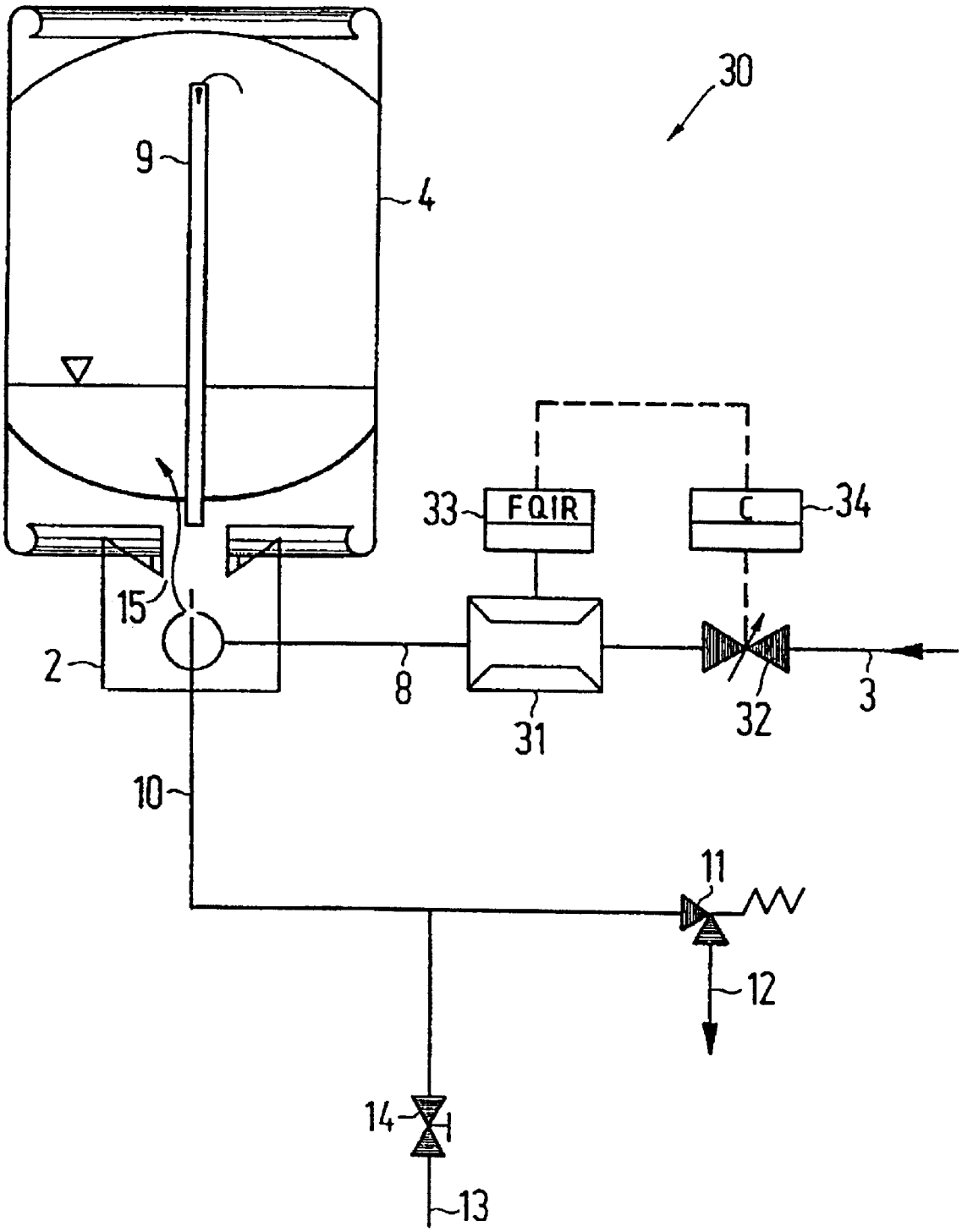
FIG. 1 shows a schematic representation of a filling station according to the invention.

The filling station 30 presented in FIG. 1 is based on the principle of low gas counterpressure in the barrel being ventilated, as described in the original application DE 197 18 130.9, whose contents are also made part of the subject of the present application. The filling station 30 basically consists of a filling valve 2, to which is supplied a liquid, such as beer, in which gases are dissolved, through a feed line 3. A barrel, in particular, a keg 4, which is to be filled with the product liquid, is placed at the filling valve 2.

In the feed line 3 there is provided a flow meter 31, coordinated with the individual filling station 1, for determining the flow velocity of the product through the line segment 8, and a continuously adjustable diaphragm 32, for example, a membrane control valve. The flow meter 31, situated upstream or downstream from the diaphragm 32, furnishes the obtained product flow data to an actual value processing unit 33, which passes on the actual flow quantity (or rate) as the actual value to a control unit (34).

In the keg 4, there is provided a riser pipe 9, which is connected to a return gas line 10 of the filling valve 2. The return gas line 10 goes to an overflow valve 11, by which the access to a return gas vent 12 is controlled. To the return gas line 10, furthermore, there is connected a pre-stress gas line 13, which can be closed off by a valve 14.

To fill the barrel 4, this is first pre-stressed by the pre-stress gas line 13 and the return gas line 10 with a pre-stress gas, in particular, $CO_2$. In the case of certain liquids, such as stout beer, the pre-stress gas can also be a composition of several gases, such as $CO_2$ and $N_2$. The pre-stress pressure in the keg 4 is only at a partial pressure corresponding roughly to the saturation pressure of the $CO_2$ or $N_2$ in the beer, or slightly over this (e.g., 1.4 bar), which is below the pressure of the product (e.g., 2.5 bars) upstream from the filling valve 2 in the line segment 8 of the feed line 3. The counterpressure of the pre-stress gas in the keg 4 corresponds to the saturation pressure of the dissolved gas after filling the keg 4, i.e., in the filled vessel. Allowance is made for the fact that beer filled with a temperature of around 3° C. is heated by around 4° C. in the keg 4 that is usually steam-treated before the filling and therefore is around 100° C. hot. The change in the saturation pressure produced in this way is already factored in when setting the original pre-stress pressure.

During the filling, the control mechanism 33 constantly compares the actual value furnished by the flow meter 31 with a set value established by a filling curve that is adapted to the barrel size, type of fitting, product temperature, proportion of propellant gas, or other parameters, and entered in a data-processing unit, and alters the flow-through quantity if necessary. For this, the continuously adjustable diaphragm 32 is used, whose cross section can be varied by a linear drive (control variable: stroke) such that a given flow-through rate (controlled variable) can be generated at any time. In this way, the usual pressure fluctuations in the product lines or the gas space can also be equalized and compensated by the very short control distances without time delay. In conjunction with a counterpressure constantly maintained at the saturation pressure, predetermined filling curves can be followed with high precision without further influencing of the internal pressure of the product in the supply line.

Figure 2:
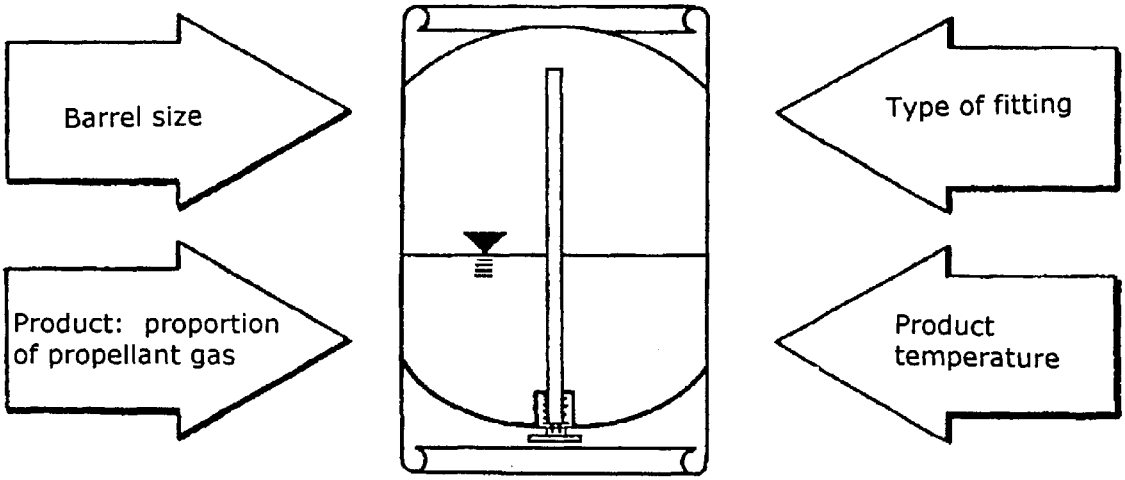
FIG. 2 shows schematically the factors of influence for establishing the filling curves, and FIGS. 3*a,b* shows a contrasting of the conventional back gas control and the control according to the invention.

The factors of influence for establishing the filling curves are presented in FIG. 2. In addition to the filling curves established by computed or empirically determined algorithms and entered in the data-processing unit, self-learning optimized filling profiles can be organized and processed for new product/barrel combinations. Provision can also be made to alter the filling curves on graphic interactive systems during the production cycle.

Figure 3A:
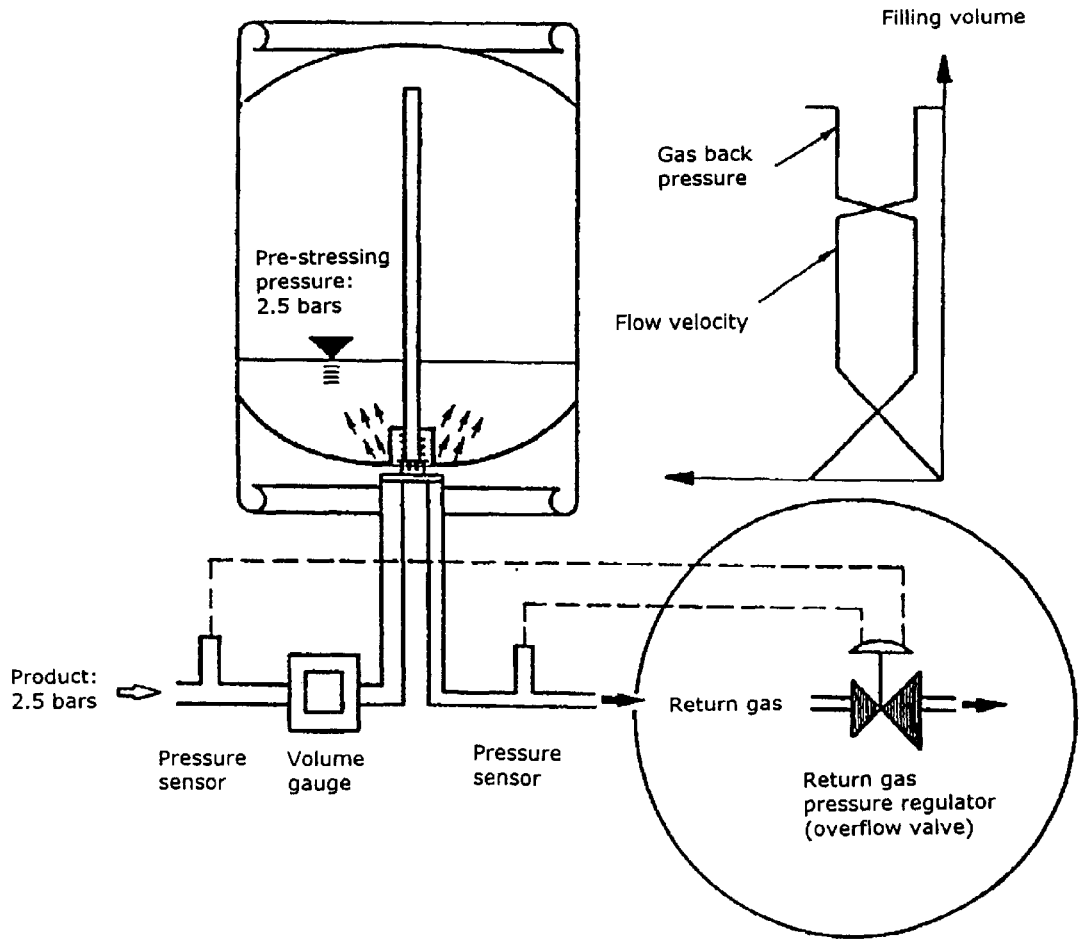
Prior art FIG.3a
Figure 3B:
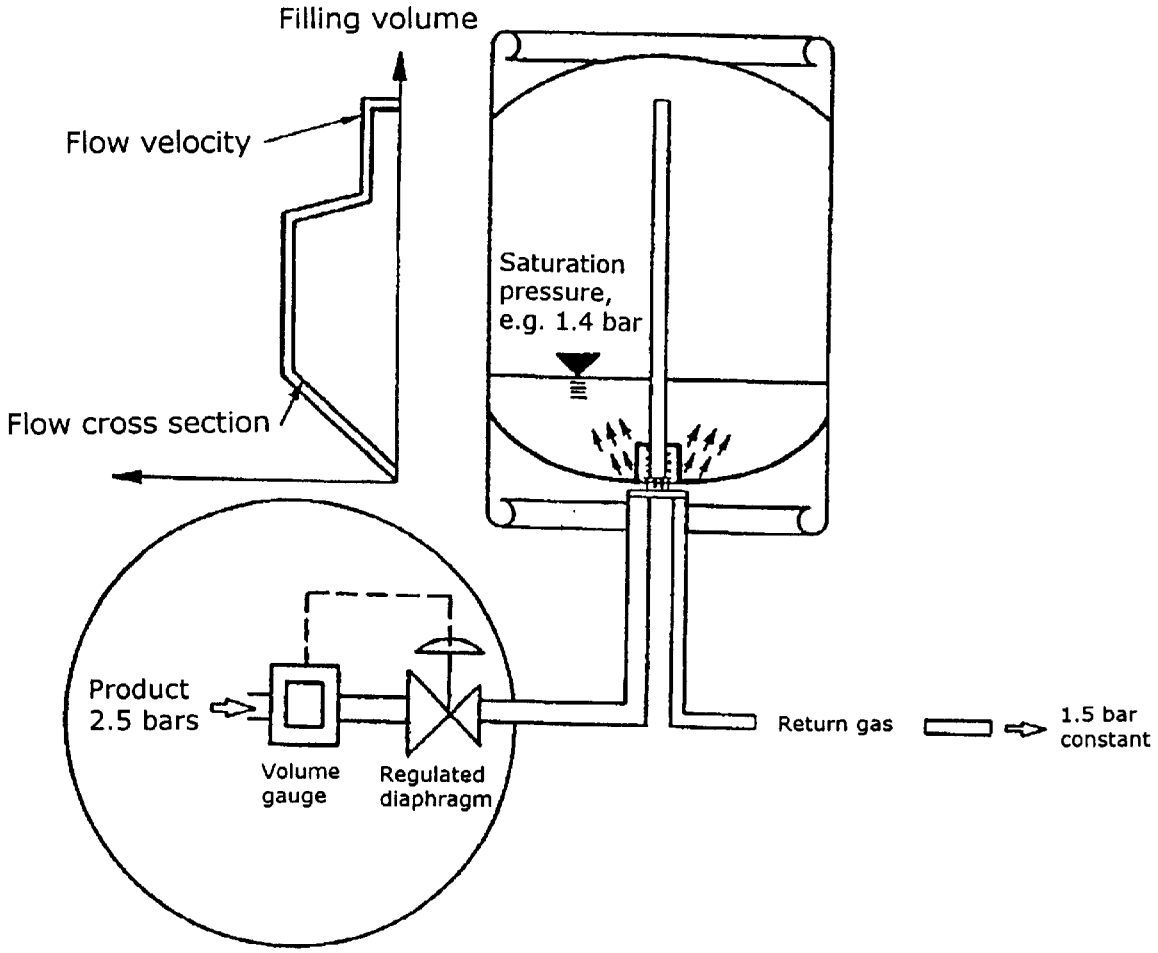

FIGS. 3*a* and *b* show a contrasting of the traditional "back gas control" and the control according to the invention. While the indirect pressure regulation always occurs counter to the flow rate, so that considerable control problems occur at the points of intersection, the flow cross section (volume flow) and flow rate in the direct control according to the invention run parallel. A very fast response to pressure changes is possible.

If the filling valve 2 is opened after the pre-stress valve 14 is closed, at first only a small amount of product enters. Spraying of the product is prevented, despite the pressure difference, by specifically reducing the feed quantity. The filling rate is then slowly increased in order not to cause any excessive turbulence. The beer delivered from the feed line 8 through the annular gap 15 in the filling valve 2 into the keg 4 forces the pre-stress gas contained in the keg 4 through the riser pipe 9 and out of the keg 4. The pre-stress gas escapes through the overflow valve 11 into the return gas vent 12. The return gas pressure established by the overflow valve 11 is a constant 1.5 bar, for example.

An important aspect of the invention is that the pre-stressing in the keg 4 only needs to be adjusted to a partial pressure roughly corresponding to the saturation pressure of the $CO_2$ (or $N_2$) in the beer and thus is far below the pre-stress pressure conventionally employed. Using the control unit 31–39 assigned to each individual filling station 30, it is possible to control the filling rate in the keg 4 without delay, so that a filling with unprecedented product protection is made possible. Damage from unwanted loss or uptake of $CO_2$ or uptake of oxygen from the pre-stress gas is avoided and the product quality is substantially improved by 40% less consumption of pre-stress gas.

List of Reference Numbers

2 Filling valve
3 Feed line
4 Keg

8 Line segment
9 Riser pipe
10 Return gas line
11 Overflow valve
12 Return gas vent
13 Pre-stress line
14 Valve
15 Annular gap
30 Filling station
31 Flow meter
32 Diaphragm
33 Actual-value processing
34 Controller

What is claimed is:

1. A method for filling a barrel with a product at a filling station connected to a feed line and having a filling valve, said product comprising a liquid, in which at least one gas is dissolved, said method comprising:

pre-stressing the barrel with a pre-stress gas at a partial pressure, roughly corresponding to the saturation pressure of one gas dissolved in the liquid;

after pre-stressing the barrel, feeding the product in a volume stream to the barrel by means of the filling valve;

measuring the flow-through rate of the product in the product feed line;

regulating the flow-through rate in the feed line by adjusting the product volume stream on the basis of a previously determined filling data that is stored in a data-processing unit; and removing the pre-stress gas contained in the barrel during the filling process.

2. The method according to claim 1, wherein the filling data comprises filling curves corresponding to at least one characteristic selected from the group consisting of different barrel sizes, types of fittings, product temperatures, and proportions of propellant gas in the product, which characteristics are determined and entered in the data-processing unit.

3. The method according to claim 1, further comprising adjusting the filling data during the ongoing filling.

4. The method according to claim 3, further comprising adjusting the filling data by employing a graphic interactive system.

5. The method according to claim 1, further comprising forcing the pre-stress gas out from the barrel by means of the inflowing product.

6. The method according to claim 1, further comprising adjusting the pre-stress pressure in the barrel such that it corresponds roughly to the saturation pressure of a dissolved gas in the filled barrel.

7. The method according to claim 1, wherein at least one of the gases dissolved in the liquid being filled is selected from the group consisting of $CO_2$ and $N_2$.

8. An apparatus for carrying out a method wherein a barrel is filled with a product comprising a liquid in which at least one gas is dissolved and the barrel is pre-stressed with a pre-stress gas before being filled with the liquid, said apparatus comprising:

a filling station;

a feed line, by which product liquid is supplied for filling a barrel provided at the filling station;

a return gas line, by which pre-stress gas escaping from the barrel is taken away;

a flow meter provided at the filling station for determining the flow rate in the feed line for the filling station;

an adjustable diaphragm for adjusting the product volume flow; and a controller responsive to the flow meter for regulating the opening and closing of the diaphragm.

9. The apparatus according to claim 8 and further comprising a data-processing unit, wherein the controller regulates on the basis of the flow-through rate determined by the flow meter as the actual value and a filling data entered in the data-processing unit as a set value.

10. The apparatus according to claim 9, wherein the filling data comprises a multiple number of filling curves.

11. The apparatus according to claim 10, wherein said filling curves correspond to at least one characteristic selected from the group consisting of various barrel sizes, types of fittings, product temperatures, and propellant gas proportions in the product.

12. The apparatus according to claim 8, wherein the diaphragm is a membrane control valve.

13. The apparatus according to claim 8, further comprising an overflow valve disposed in the return gas line.

14. A method for filling barrels with a product at corresponding filling stations each connected to a feed line and having a filling valve, said product comprising a liquid, in which at least one gas is dissolved, said method comprising:

pre-stressing each barrel with a pre-stress gas at a partial pressure, roughly corresponding to the saturation pressure of one gas dissolved in the liquid;

after pre-stressing the barrels, feeding the product in a volume stream to the barrels by means of the corresponding filling valve;

measuring the flow-through rate of the product in each product feed line;

regulating the flow-through rate in the feed line by adjusting the product volume stream on the basis of previously determined filling data that is stored in a data-processing unit; and removing the pre-stress gas contained in the barrels.

15. The method according to claim 14, further comprising determining filling curves based on at least one characteristic selected from the group consisting of different barrel sizes, types of fittings, product temperatures, and proportions of propellant gas in the product, and entering said filling curves in the data-processing unit.

16. The method according to claim 15, further comprising adjusting the filling curves during the ongoing filling.

17. The method according to claim 16, further comprising adjusting the filling curves by employing a graphic interactive system.

* * * * *